United States Patent [19]

Berzins

[11] 4,067,452

[45] Jan. 10, 1978

[54] CHARGING APPARATUS FOR RECEPTACLE

[75] Inventor: Andrejs Berzins, Parma, Ohio

[73] Assignee: Arthur G. McKee & Company, Cleveland, Ohio

[21] Appl. No.: 665,552

[22] Filed: Mar. 10, 1976

[51] Int. Cl.[2] ..... F27B 5/12

[52] U.S. Cl. ..... 214/2; 214/18.2; 214/36; 266/99; 266/184

[58] Field of Search ..... 214/18.2, 36, 37, 2; 266/99, 184

[56] References Cited

U.S. PATENT DOCUMENTS

| | | | |
|---|---|---|---|
| 864,053 | 8/1907 | Witherbee et al. | 214/37 X |
| 1,996,784 | 4/1935 | Zimmermann | 266/184 X |
| 2,563,681 | 8/1951 | Johnson et al. | 214/36 |
| 3,476,268 | 11/1969 | Munson | 214/18.2 X |
| 3,706,387 | 12/1972 | Tokarz | 214/37 |

*Primary Examiner*—Robert G. Sheridan
*Attorney, Agent, or Firm*—Bosworth, Sessions & McCoy

[57] ABSTRACT

Disclosed is charging means for a shaft furnace such as an oil shale retort or blast furnace comprising a stationary outer distributor member having a donwardly converging inner wall and a movable member having upwardly converging upper wall, which latter member is adapted to move in an upright path between positions below and above the bottom of the distributor. A plurality of port means are fixed in the top wall of the furnace above the distributor members, each port means having a gas sealing valve and a material holding gate. Above the port means is a distribution hopper having a number of downwardly extending legs each connected to one of the port means, and adapted to distribute to each of the port means charge material that is supplied to the top of the distribution hopper through a material holding gate and a gas seal. The distribution hopper is supported by load cells which measure the weight of the charge material delivered to the distribution hopper. A plurality of stock rods in the furnace are adapted to be lowered to the height of the stockline in the furnace and then to be raised out of the way of charging material. These stock rods, valves, gates and load cells are connected to circuit means embodying a programmable logic unit that controls these ports to permit the charging to proceed automatically when the stock rods determine that the level of the stockline is sufficiently low to require the addition of charge material.

18 Claims, 14 Drawing Figures

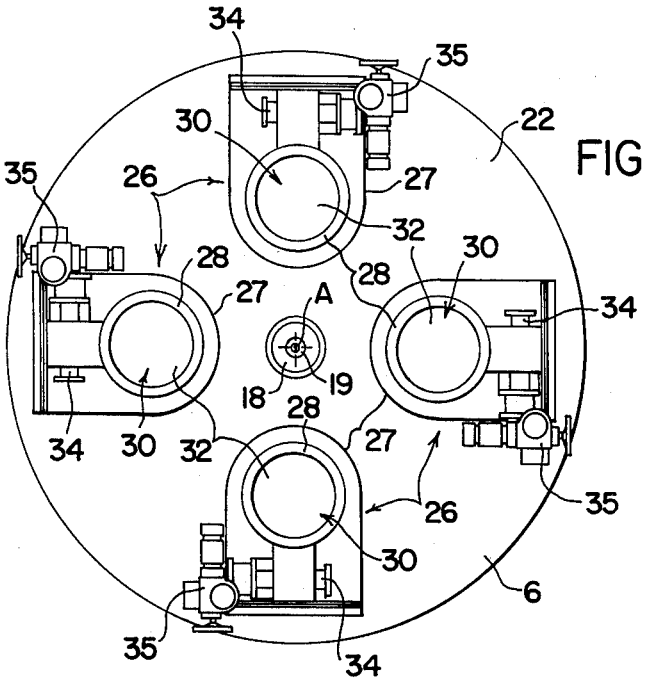
FIG. 2
FIG. 4
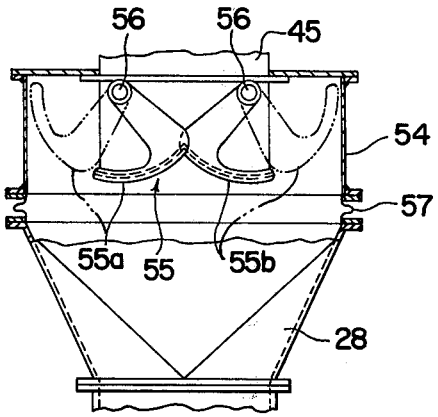
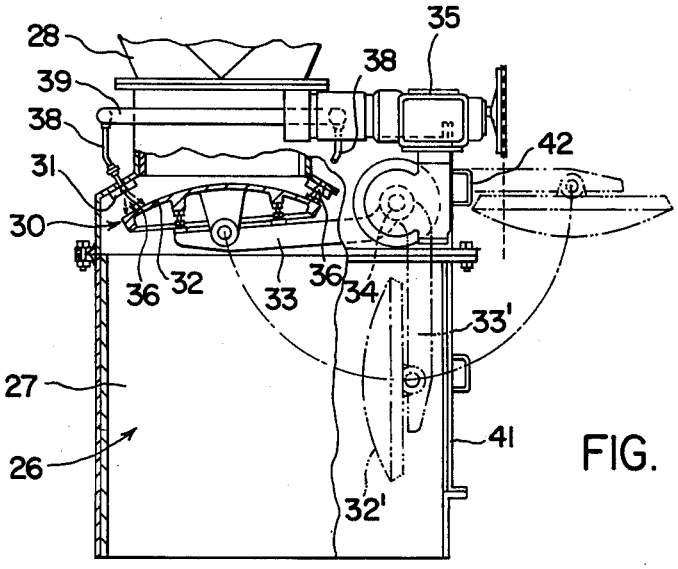
FIG. 3

CHARGING APPARATUS FOR RECEPTACLE

DISCLOSURE OF THE INVENTION

1. Field of the Invention

This invention relates to apparatus for charging particulate material into a receptacle such as a blast furnace or upright oil shale retort or other shaft furnace, coal gasifier, or pyroprocessing preheater, kiln or cooler. More particularly it pertains to a furnace for charging particulate charge material into such a receptacle to distribute the material in the receptacle to provide a level or desired shape of the top surface or stockline of the material in the receptacle and high uniformity of distribution of sizes of particulate material in the body of charge material in the receptacle.

2. Background of the Invention

While the invention may be used for other purposes, it provides particular advantages when used as a distributor for distributing particulate oil shale material into a vertical oil shale retort, and therefore the invention will be discussed below as so used.

In general, the known upright oil shale retort used for recovering oil from crushed particulate oil shale, has an upright stack furnace portion and particulate oil shale is introduced at the top to form a body of oil shale in the retort, through which the shale moves downwardly as the shale is heated to remove the oil containing components and other constituents after which the spent oil shale is discharged from the bottom of the furnace portion.

Between the upper and lower portions of the body of shale in the retort, means is provided to heat the particulate oil shale to drive off the oil containing constituent as vapors, and gases; recycled gases mixed with a predetermined amount of air are supplied in an amount predetermined to burn residual carbon on the oil shale to provide heat for driving off the oil containing constituents and gases. Air is also supplied from the bottom or generally midway of the retort and travels upwardly through the body of shale; as the air progresses upwardly it cools the hot spent shale and itself is preheated; air thus preheated is used in combination with the fuel-air mixture at the heating means to burn residual carbon and provide necessary heat for the process. Heat for the process may also be supplied by recycling the product gases through a separate retort, the hot recycled gases thus supplying the sensible heat required for the process. The oil containing constituents and gases are removed by heat from the shale in the form of oil vapor mixed with gases and water vapor, which mixture moves upwardly through the body of oil shale and enters the space above the oil shale in the upper portion of the retort, from which it is removed. This mixture of gases and oil and water vapor is hot, and this preheats the oil shale as it moves downwardly in the body of shale in the retort.

Heretofore, charging means has been provided for charging, by gravity feeding, the crushed particulate oil shale into the upper portion of the retort. Such means has been intended to distribute the crushed particulates across the cross section of the interior of the retort to form a desired stockline. However, the charging means heretofore used for distributing the crushed particulates in the upper part of the retort have been deficient in various respects, particularly when the cross section of the retort is large.

When the oil shale is crushed prior to being charged into the retort, the crushing invariably produces particles of a wide variety of sizes; even if the crushed oil shale is screened preparatory to being charged into the retort, it still consists of particles of various sizes. Physical movement of the crushed oil shale often tends to cause the smaller particles or fines to segregate from the larger particles. Consequently the crushed particulate oil shale charged into the retort tends to segregate, which can provide detrimental results during the retorting treatment of the shale, unless provided against. Segregation of the smaller particles or fines from the large particles in the retort is higly disadvantageous because the fines tend to agglomerate to form clinkers which cause non-uniform operation of the retort, and in fact failure in operation at times. Non-uniform operation occurs because the clinkers, or other larger sizes of oil shale particles caused by non-uniform distribution, permit gas passing through the body of oil shale in the retort to channel through portions of the body containing the segregated larger particles or clinkers, leaving other portions of the body of charge material insufficiently treated to remove satisfactorily the oil-containing constituents and fuel gas.

Similar channeling can occur if the stockline of the charge material in the retort varies substantially in height since gas will preferentially flow through the lowest portions of the stockline because it flows through less material.

Widely used distributors having one or more vertically movable bells have usually been deficient because, among other things, they do not insure that a level stockline in the desired height could be provided and maintained, and because at least the bottom bell usually caused flow patterns of such nature that the fines tended to segregate in generally cylindrical columns in the body of material in the furnace, thus causing problems such as those described above.

Rotating types of distributors heretofore proposed in general have been deficient in that they did not insure that the particulate oil shale was spread uniformly, did not provide substantially uniform mixture of large and small particles of oil shale, and did not maintain a desired height and contour of the stockline. For example, if the oil shale should be supplied by a distributing belt and the finer particles of oil shale should be located on and discharged at one side of the belt into the rotating distributor, then the rotating distributor would cause the fines to be largely distributed over only about half of the cross section of the retort. Moreover, in general the prior types of rotating distributors also tend to cause segregation in the body of oil shale because of the tendency of finer particles to segregate from the larger particles during gravity flow of the material.

Furthermore, problems have arisen with both types of distributors heretofore used when it was attempted to feed particulate charge material continuously through distributors of a number of retorts connected by belts or other conveyor means to a source of crushed particulate oil shale such as a crushing mill. This has arisen because in general such distributors require material to be delivered to them discontinuously whereas the system for feeding distributors of a sizeable number of retorts from a single source does not lend itself to discontinuous feeding and continuous feeding would introduce complications in the conveyor system.

Similar, although in some cases not identical, problems occur in the feeding of particulate charge material into blast furnaces, and the invention may be also used to particular advantage for such purpose.

SUMMARY OF THE INVENTION

It is an object of the invention to avoid the above and other problems and disadvantages of prior art apparatus.

It is a further object to provide apparatus for charging material into a receptacle such as an oil shale retort that will operate efficiently in large or small receptacles, to charge desired quantities of particulate material, to provide and maintain the desired height of the charge material in the receptacle, to provide a desired level of stockline or other contour of stockline depending on the design of the apparatus, and to provide a highly uniform distribution of particle sizes of charge material in the body of charge material in the receptacle.

The present invention provides apparatus for charging particulate charge material into a receptacle, such as an oil shale retort, comprising distributor means within the upper portion of the receptacle, gas lock means permitting entrance of charge material into the receptacle, the gas lock means being independent of the distributor means, and distribution hopper means outside of the receptacle adapted to receive a measured amount of charge material and after the predetermined measured amount of charge material has been received to automatically discharge it into said receptacle through said gas lock means.

The invention further embodies apparatus of the above type in which the distributor means comprises an outer distributor member providing a chamber having a lower opening into which member charge material is deposited from said distribution hopper, and an inner distributor member having a maximum perimeter smaller than but approaching the cross section of the said opening in the outer member, and means for causing relative movement between the distributor members in an upright path between a position in which the maximum perimeter of the inner distributor member below the opening in the outer distributor member and a position in which its maximum perimeter is above the opening in the outer distributor member.

The apparatus further embodies apparatus of either of the two immediately preceding paragraphs and which comprises bell means in the receptacle above said inner distributor member, and a bell hopper above said outer distributor member having a bottom opening adapted to be closed by the bell means, the bell means having a lower perimeter that is substantially greater than the perimeter defined by the opening in said hopper so that when the upper bell is lowered it discharges charge material laterally for a substantial distance into the lower distributor hopper.

The invention also embodies apparatus such as that of any of the three preceding paragraphs comprising a receiving hopper above the previously mentioned external distribution hopper adapted to receive charge material substantially continuously from a source such as a belt conveyor, temporarily store it, and discharge charge material into the external distribution hopper until a predetermined amount of charge material is discharged into the distribution hopper from whence it is discharged into the receptacle.

BRIEF DESCRIPTION OF THE DRAWINGS

These and other advantages of the invention will become apparent from the following description of two preferred embodiments of the apparatus in connection with the accompanying drawings:

FIG. 2 is a section along line 2—2 of FIG. 1 and to a larger scale;

FIG. 3 is a detail to a larger scale of one of the gas seal valves;

FIG. 4 is a detail to the scale of FIG. 3 of one of the material holding gates;

DESCRIPTION OF PREFERRED EMBODIMENTS

Figure 1:
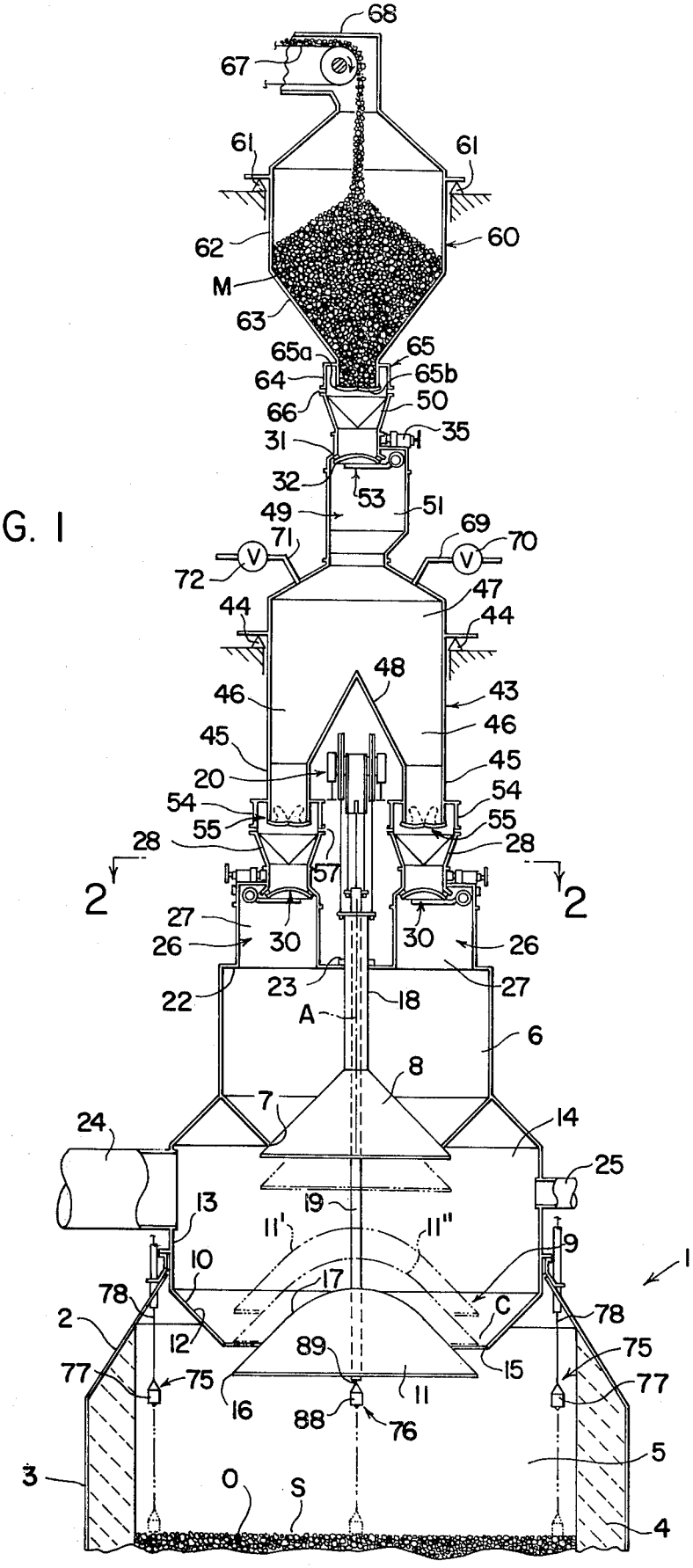
FIG. 1 is a vertical section through the upper part of an oil shale retort including charging apparatus embodying the invention.

The apparatus of FIGS. 1 to 13 inclusive is a vertical oil shale retort 1 of otherwise known construction. It has an upper portion 2 comprising a metal shell 3 of generally circular cross section having an inner lining 4 defining a retorting chamber 5 of generally circular cross section in which is disposed a body of oil shale O having an upwardly facing surface or stockline S. The apparatus illustrated comprises an internal stationary bell hopper 6 of generally circular cross section having a bottom opening 7 of circular cross section adapted to be closed and opened by vertically movable circular cross sectioned spreader bell 8 that when closed holds charge material in hopper 6 and when opened permits charge material to drop out of the hopper. The bottom edge portion of bell 8 extends a substantial distance beyond the edge of hopper opening 7, to provide a desirable spreading effect in charge material passing through opening 7, as described later.

Charge distributor means 9 is located in the upper portion of the retort below the hopper 6 and bell 8; it comprises a stationary outer distributor member 10 and a movable inner distributor member 11. Member 10 has an inwardly and downwardly converging preferably frustoconical inner surface 12 terminating at its upper end in a generally vertical wall 13 of generally circular cross section to define a chamber 14, and at its lower end in a bottom opening 15 of circular cross section. Member 11, which is of circular cross section, has a lower maximum perimeter portion 16 and an upwardly inwardly converging top surface 17, and is mounted for movement in an upright path extending between a lowermost position in which member 11 has its lower portion 16 and surface 17 substantially below opening 15 as shown in full lines in FIG. 1, and an uppermost position in which member 11 has its lower portion 16 and surface 17 substantially above the opening 15 in the portion of chamber 14 having converging surface 12, as shown in the upper broken lines 11' in FIG. 1. Hopper 6, bell 8, distributor members 10 and 11, and openings 7 and 15 are concentric about the axis A of the retort in the illustrated embodiment, as is preferable. Generally annular space or clearance C between the perimeter portion 16 of the inner member 11 and the opening 15 of outer member 10 is large enough to permit member 11 to pass freely through the opening but small enough to restrict movement of the charge material through the opening when member 11 is positioned with its lower portion 16 substantially in opening 15 of the hopper, as shown in broken lines 11" in FIG. 1.

Bell 8 is supported, lifted and lowered by a tubular rod 18, and distributor member 11 is supported, lifted and lowered by rod 19 extending axially through rod 18. The bell 8 and member 11 may be non-rotatable but if desired either may be rotated, bell 8 free of its hopper, to equalize wear. Known means 20 are provided for actuating the rods to raise and lower bell 8 and member 11 as required, and for rotating them if desired.

Top wall 22 closing the retort has known sealing means 23 operating between rods 18 and 19 and between rod 18 and wall 22 to prevent escape of gas.

Conduits 24, 25 open into the upper portion 2 of the retort, above stockline S to permit removal of vapors and gases produced as a result of the retorting operation.

The top wall 22 of the retort has a plurality, four in the illustrated embodiment (FIG. 2) of port means 26 disposed around axis A and fixed gas-tight to wall 22. Each port means comprised a housing portion 27 having an upper conduit portion 28 all of which are of the same size and equidistant from and preferably equiangularly spaced around axis A. Each housing portion includes a gas sealing valve 30 (FIGS. 1, 2, 3), in housing portion 27 adapted to close and open the lower end of conduit 28 of each port means 26. Each valve 30 comprises a stationary valve seat 31 preferably formed as shown of heat resistant resilient material and an upwardly convex movable closure member 32 pivotally mounted on an offset arm 33 fixed to a horizontal rotatable shaft 34 that extends outwardly of housing portion 27 and is sealed against gas leakage. Shaft 34 is rotated as required by known actuating means 35 of known construction, to move closure member 32 against the seat 31 to close the valve, and to move member 32 to the open position, shown in broken lines 32' in FIG. 3 to open the valve. If desired, the valve seat (as shown) may have apertures 36 through which pressurized gas may be supplied from pipes 38 and 39 to keep the seating portions of the valve seat and closure members free of obstructions that can impair sealing.

The arrangement including offset arm 33 is such that when the closure member is closed as shown in FIG. 1, it closes conduit portion 28 and provides a gas tight seal even if there should be substantial gas pressure in the retort, the gas pressure acting on the closure member to aid in keeping the valve closed tight. When arm 33 is turned to the position shown in broken lines (FIG. 3), all portions of the valve completely clear the flow passage and permit an uninterrupted and unimpeded flow of charge material through the port means into the bell hopper 6. Doors 41, 42 are provided to permit access to the interior of housing portion 27 and to member 32 and to arm 33 for maintenance.

Usually each valve 30 is operated in unison with the other valves 30 although each valve may be operated independently of the other valves when desired. The actuation means is electrically controlled by suitable means such as that described later.

A distribution hopper 43 mounted immediately above the port means 26 is supported for limited vertical movement in a fixed path by a plurality, preferably three, of known load cells 44, diagrammatically shown in known supporting means. The load cells are adjustable to provide electrical signals when the hopper 43 has a predetermined weight of charge material deposited therein at a weight set point, and when the hopper 43 is empty of charge material, such signals being utilized by suitable means such as that later described.

Hopper 43 has a plurality of downwardly extending legs 45 equal in number to the port means 26 each adapted to discharge into one of the port means, there being four such legs in the illustrated embodiment. Each leg is generally cylindrical in cross section and at its lower portion opens through an upwardly widening transition portion 46 into a generally cylindrical upper hopper portion 47, the transition portion having a generally frustoconical central wall 48 coaxial about axis A. An entrance port means 49 has conduit portion 50 located coaxially of axis A of hopper 43 so that material discharged through such conduit drops onto the frustoconical portion 48 and is divided and distributed in substantially equal amounts to each of legs 45.

The port means 49 is similar to each individual port means 26 at the upper portion of the retort in that it comprises a housing portion 51 embodying conduit portion 50 and gas sealing valve 53 similar to valve 30 described above and comprising a valve seat 31 and a closure member 32 adapted to be opened and closed by actuating means 35.

The lower portion of each leg 45 of hopper 43 has fixed to it an enlarged cylindrical portion 54 internally supporting a material holding gate 55, comprising a pair of pivotally mounted cooperating closure members **55*a* and 55*b*, (FIGS. 1, 4) adapted by suitable known actuating means 56 to be closed to hold charge material in hopper 43 and opened to permit discharge of charge material from the hopper through the associated leg 45 of the hopper. The actuating means 56 are controlled by electrical signals from suitable means, such as that described later. The gates for all leg portions are usually opened and closed in unison; however, the gate for each individual leg is adapted to be opened and closed individually when desired. The lower portion 54 of each leg and the upper portion of the conduit portion 28 of each port means 26 are joined by a known expansible and contractable sealing means 57 to provide a gas tight seal between the hopper 43 and the several port means 26 while permitting suitable movement of the hopper 43** relative to the port means when the hopper moves in an upright path in response to the load in the hopper.

A receiving hopper 60 is also supported by known means above hopper 43 by a plurality of known load cells 61 preferably three load cells, for limited movement in an upright path. This hopper, which is preferably of cylindrical cross section at its central portion 62 has a lower conical portion 63 terminating in an enlarged discharged portion 64 containing a gate 65 similar to each of gates 55, comprising pivotally mounted members 65*a*, 65*b*, that cooperate to close and open the bottom of the hopper and permit charge material within the hopper to be held in hopper 60 or to be discharged through port means 49 into hopper 43 as required after gas sealing valve 53 is opened. The discharge portion 64 of hopper 60 is connected to the port means 49 of hopper 43 by suitable flexible sealing means 66 that permit limited vertical movement of the hoppers relative to each other while preventing the escape of dust or gases.

In the illustrated apparatus, a belt conveyor 67 is provided to discharge particulate oil shale material continuously into hopper 60 the conveyor being enclosed in a suitable housing 68 to prevent escape of undesirable gases or dust.

Distribution hopper 43 also has a conduit 69 controlled by valve 70, to permit discharge of gas from the interior of the hopper 43 to relieve the pressure in the hopper to that of the atmosphere before the gas sealing valve 53 and gate 65 at the upper portion of the hopper are open to permit charge material to drop into hopper 43 while gates 55 and gas sealing valves 30 are closed. Hopper 43 also has another conduit 71, controlled by a valve 72, to permit suitable gas to be introduced into the interior of hopper 43 to raise its internal pressure to that of the gas pressure in the retort after the gate 65 and gas sealing valve 53 have been closed and before any of the longer gas valves 30 and gates 55 have been opened to permit discharge of charge material from hopper 43 into the hopper portion 6 of the retort 1.

From the above, it is apparent that the above described valve containing portions of hoppers 43 and 60 and port means 26, in combination with hopper 43 itself provide gas lock means permitting charge material to be introduced from receiving hopper 60 into distribution hopper 43 and from hopper 43 into hopper 6 in the retort without undesired loss of vapors or gas from within the retort, by suitable actuation of the above described gas sealing valves 30 and 53 of material holding gates 55 and 65, and gas relief and pressurizing valves 70 and 72.

Figure 5:
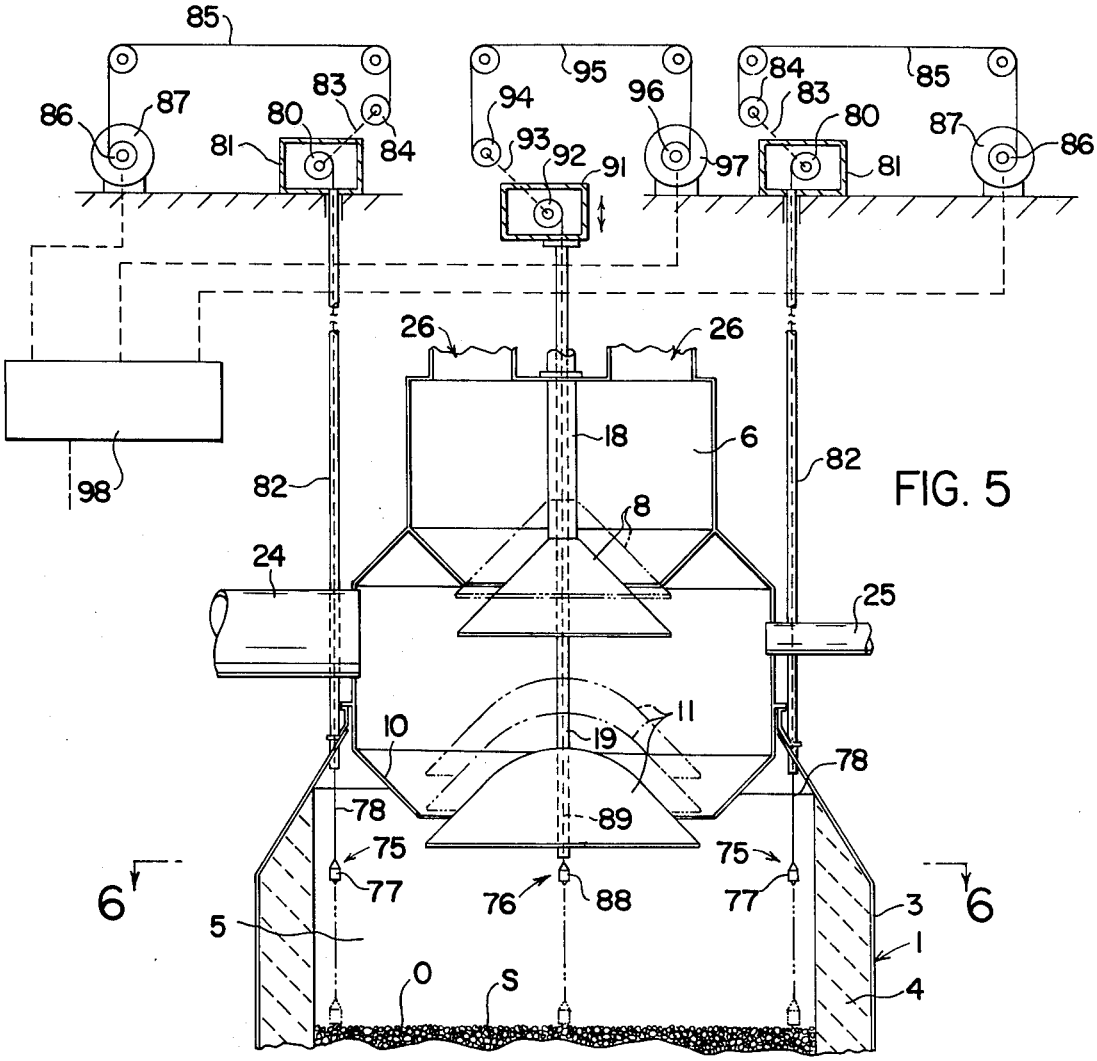
FIG. 5 is a diagrammatic view of a portion of the retort showing means for raising and lowering stock rods.
Figure 6:
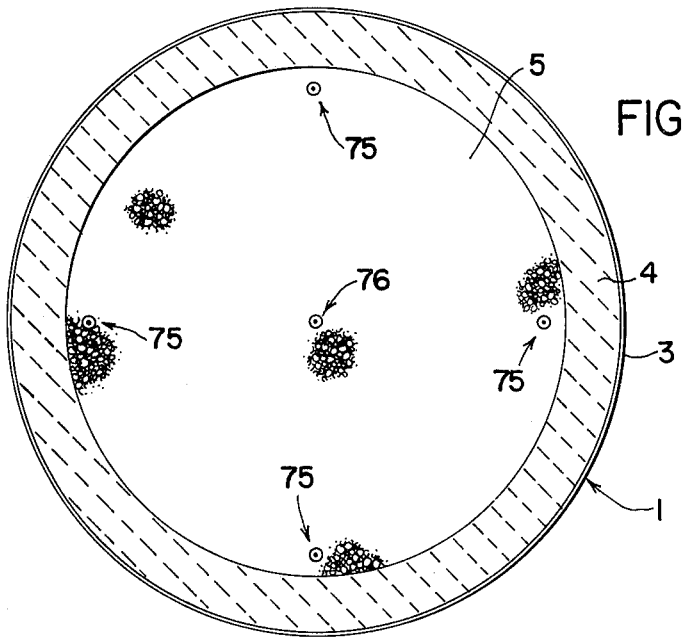
FIG. 6 is a section along line 6—6 of FIG. 5.

To control the position or movement of the distributor member 11 and to control the feed of charge material into the retort 1 to achieve a desired stockline height and level, stockline sensing means as illustrated in FIGS. 1, 5 and 6 may be used. The apparatus of these figures includes a plurality, four in the illustrated embodiment, of outer stockline level sensing devices 75 equidistantly and equiangularly spaced to determine the height of the stockline near the outer periphery of the stockline in the retort. There is also another stockline level sensing device 76 located substantially coaxially of the retort to check the height of the stockline centrally of the retort. More specifically, each stockline sensing device 75 may be a known device often referred to as a "stock rod", comprising a sensing member 77 of substantial weight and preferably having a conical lower point, which member is supported by a steel cable 78 adapted to be wound on and unwound from a winch drum 80 mounted in a gas-tight housing 81 that communicates with the retort chamber 5 through vertical tube 82. Therefore, member 77, its cable 78 and its winch drum 80 are at all times exposed to the pressure of gas in the furnace. Each winch drum 80 is mounted on a shaft 83 extending through a wall of housing 81 through a known sealing means that prevents escape of gas past the shaft. Each shaft 83 rigidly carries another winch drum 84 adapted to wind on and off the drum another cable 85 that winds on or off a third winch drum 86 driven by sensing motor 87.

Sensing device 76 comprises a sensing member 88 suported by a steel cable 89 extending longitudinally through rod 19 for distributor member 11 which rod is made hollow for the purpose. A housing 91 is mounted on the top of rod 19 and rides up and down with it. The upper portion of cable 89 is wound on a winch drum 92 in housing 91. Drum 92 is fixed on a rotatable shaft 93 extending outside of and sealed to the housing and rigidly carrying a winch drum 94 by which is wound and unwound cable 95 adapted to wind on and off a winch drum 96 mounted on the shaft of a sensing motor 97.

In known manner the sensing members 77 and 88 are usually kept in an upper out of the way location as shown in FIG. 1 until it is desired to check the stockline level, when the members are lowered by suitable operation of their motors 87 and 97 until the members 77 and 88 contact the charge material in the furnace and stockline, when the motors stop. Information as to the level of the material sensed by each such member is provided by the number of turns of the motor necessary to lower the members to stockline sensing levels in known manner. This information can be read out from known indicating means 98 and used to control the operation of the charging apparatus, including the passage of charge material into the receiving and distribution hoppers, of the illustrated embodiment to provide charging and distribution of charge material to provide a stockline of desired height and shape, such as a substantially level stockline. Moreover, the information supplied to indicating means 98 is also supplied to known logic unit 100 (FIG. 7) which provides automatic or programmed control of the charging operation as described below.

Figure 7:
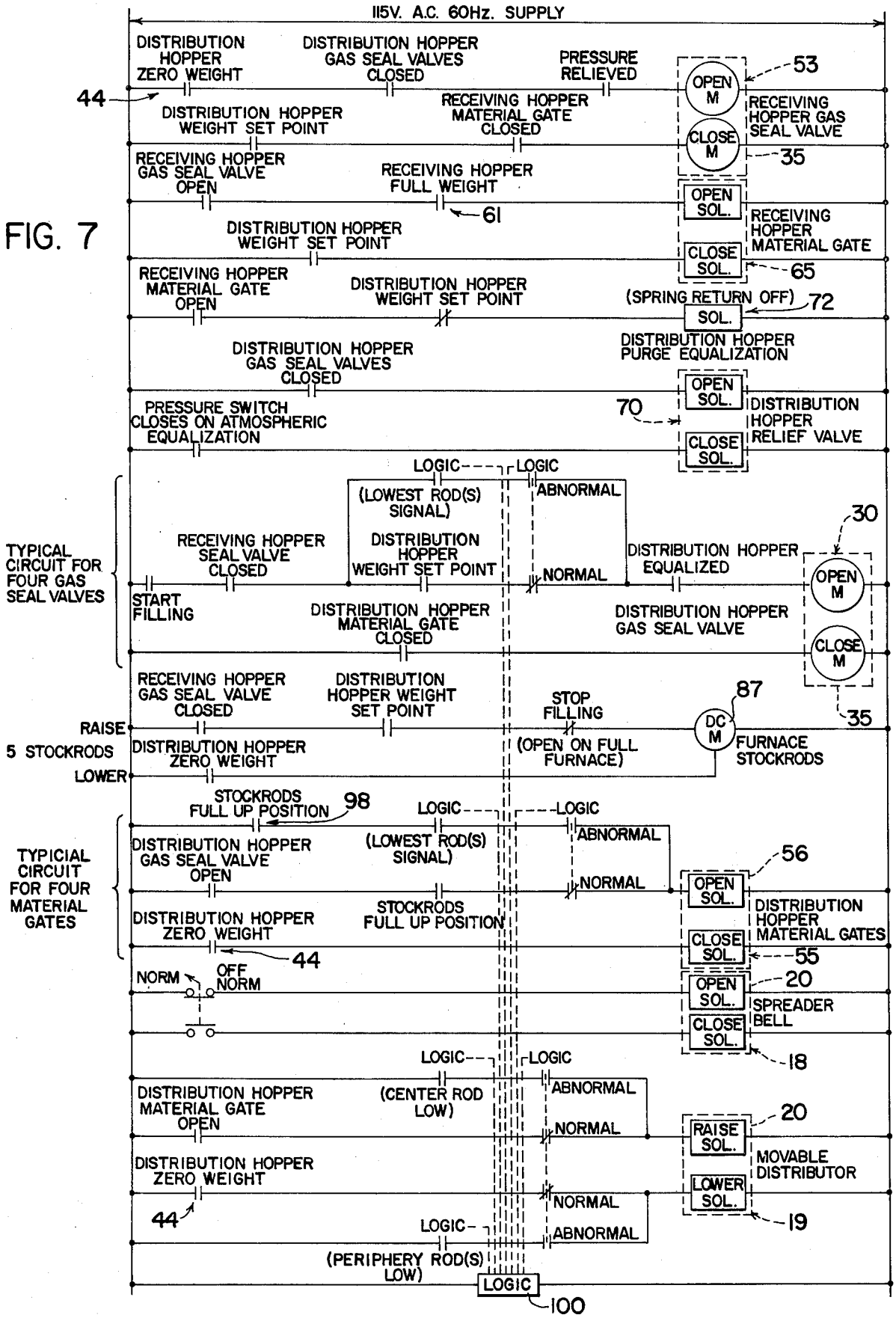
FIG. 7 is a schematic view of an electrical circuitry and logic system for controlling the apparatus.

FIG. 7 illustrates preferable circuit means and circuit elements for controlling the apparatus previously illustrated in accordance with the following preferred method, as well as other methods, of operation.

Figure 8:
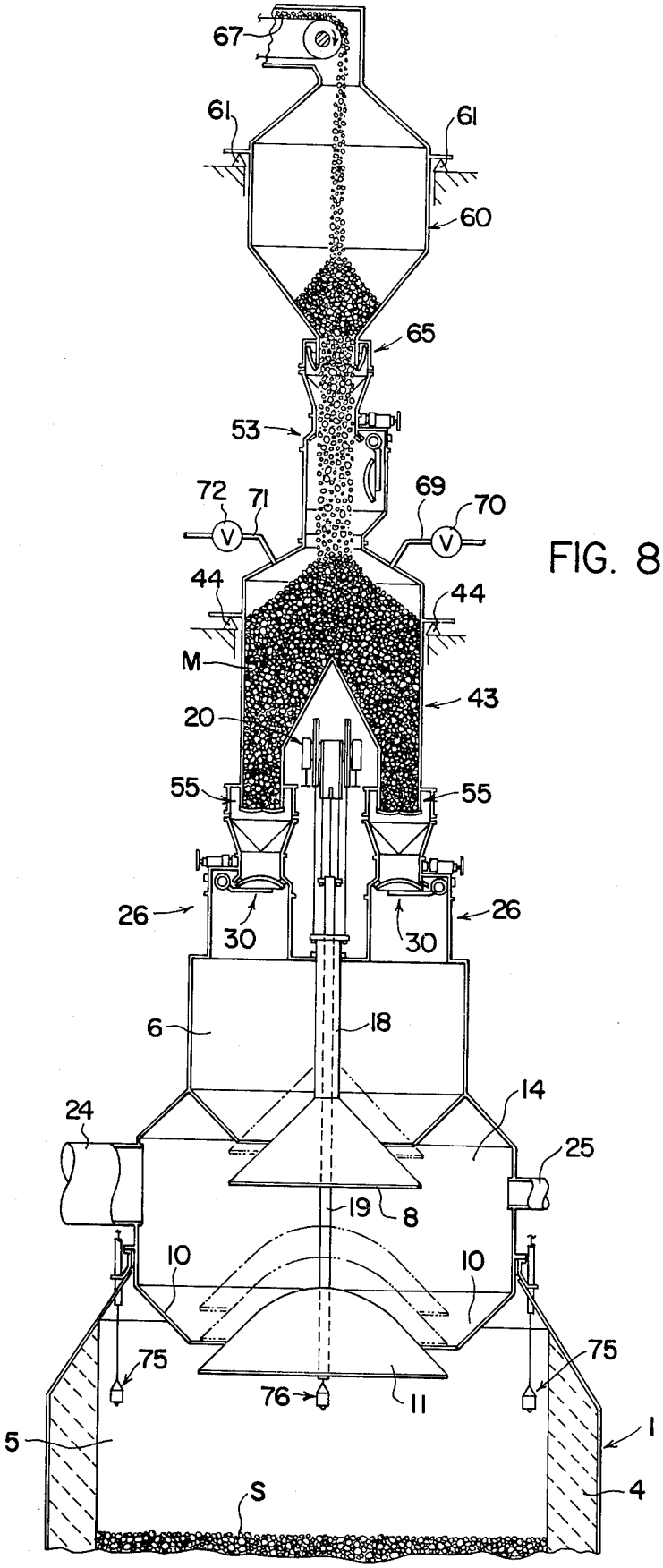
FIG. 8 is a view of the apparatus of FIG. 1 and to the same scale, illustrating a step in a preferred method of operation.

It is assumed for the purpose of disclosure of the following method that the retort is actively in operation, has been filled to its desired full position with charge material M, in this case crushed oil shale, and is waiting for resumption of a charging signal. Charge material is continuously discharged into receiving hopper 60 by conveyor 67. It is further assumed that the movable distributor member 11 is in its lowermost position and that the distribution hopper 43 has been filled by opening gas sealing valve 53 and then material holding gate 65 while gas sealing valves 30 and material holding gates 55 of port means 26 are closed, until hopper 43 is filled to a predetermined weight (FIG. 8). Gate 65 and valve 53 then are closed and the gas pressure in hopper 43 is equalized to the furnace top gas pressure by introduction of gas through conduit 71 and its valve 72. The receiving hopper 60 which receives charge material continuously can be filled to its full set point weight as sensed by the load cells 61, which so signal the logic unit 100 (FIG. 7).

The above described actuating means for the five electrically operated stock rods 75, 76 have been controlled by logic unit 100 to lower the stock rods to measure the level of the stockline at all four quadrants and in the area directly under the distributor member 11. When the stockline S of oil shale in the retort moves down to a predetermined level, the stock rods sense that level and signal the logic unit 100 which then calls for a resumption of charging.

The logic unit 100 initiates this charging action by signalling the actuators of all of the four electrically operated gas seal valves 30 of the distribution hopper 43 to open the valves. At the same time the unit 100 causes the stock rods 75, 76 to be raised to their uppermost position. The four hydraulically operated distribution hopper material gates 55 are then signalled to open by the logic unit 100.

Figure 9:
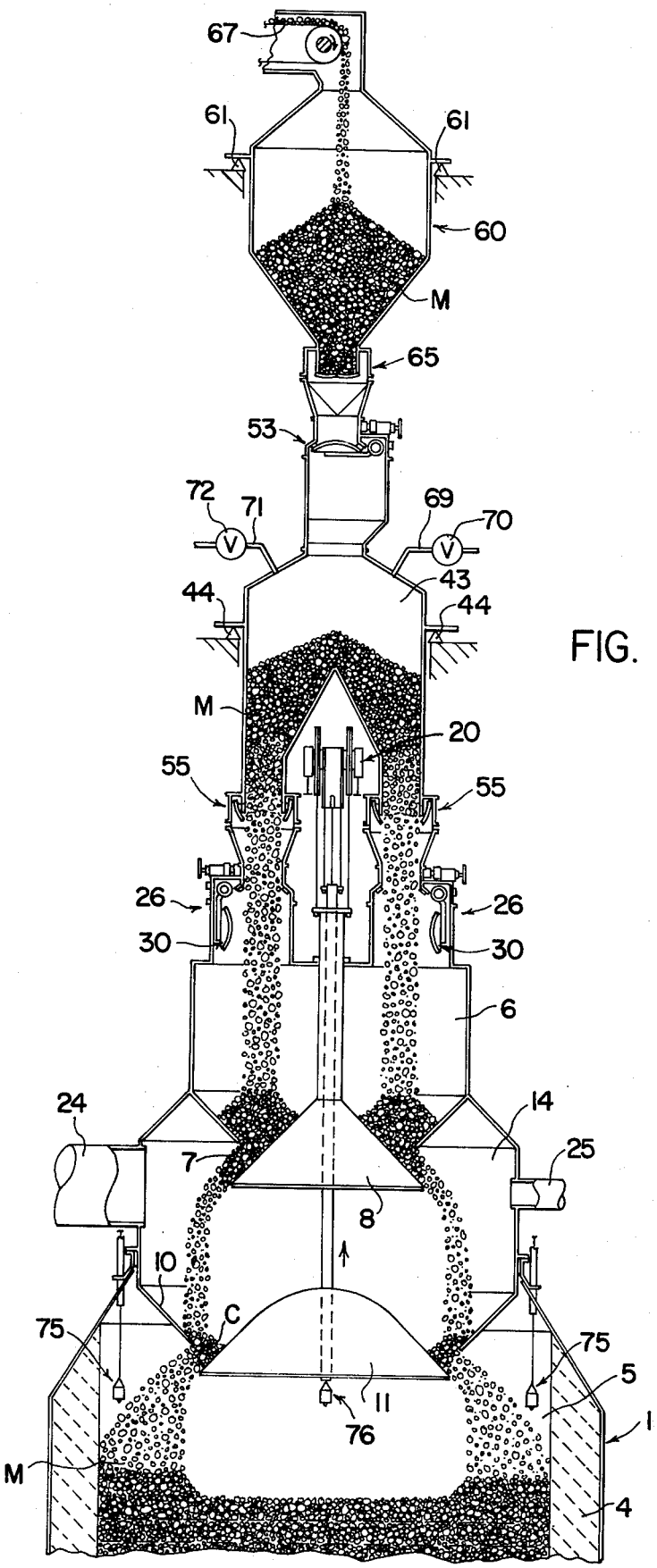
FIG. 9 is a view of the same apparatus showing a following step in such method of operation.
Figure 10:
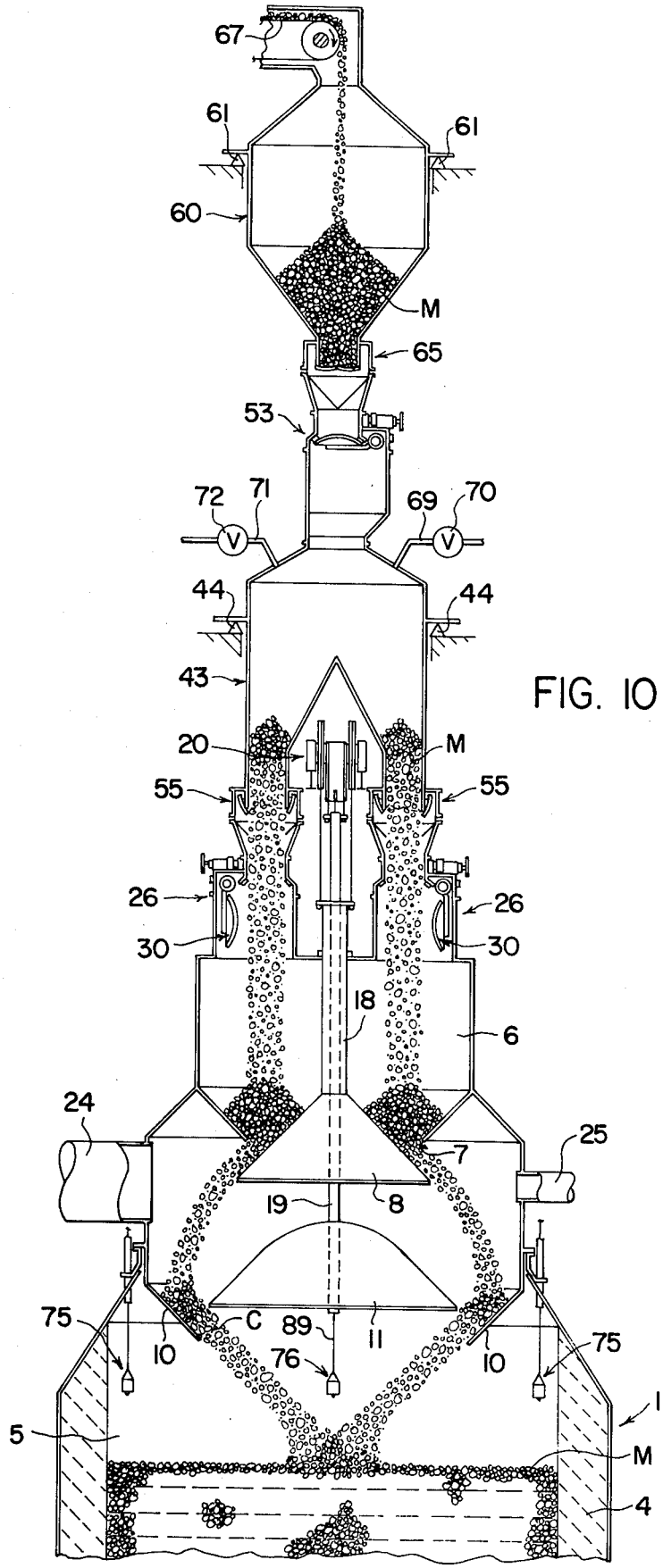
FIG. 10 is a view of the same apparatus showing another following step in the method of operation.

Charge material M is then discharged from the distribution hopper through the four port means 26 where it is evenly spread into the distributor member 10 by the spreader bell 8 (FIG. 9). The substantially larger cross section of the hopper portion of the bell as compared to the cross section of the opening 7 in bell hopper 6, together with the upwardly inwardly converging surface of bell 8, promotes a desirable wide spreading action. As member 11 is raised through the charge material flowing downwardly into and through distributor member 10, it causes a change in the configuration of the annular clearance C between the distributor members 10 and 11. The resultant change will cause the charge material to distribute in a level layer extending from the periphery of the retort to the center of the stockline under member 11 (FIG. 10).

When the load cells 44 supporting distribution hopper 43 indicate zero weight of charge material in the hopper to the logic unit 100, the gates 55 are signaled to close by logic unit, distributor member 11 is lowered to its lowermost down position and stock rods 75 and 76 are then signaled by logic unit 100 to lower to the stockline of the charge material in the furnace.

Immediately after the distribution hopper material gates 55 have completely closed the distribution hopper gas sealing valves 30 also close. Thereafter, the internal pressure in the distribution hopper is relieved to atmospheric pressure by control of relief valve 70 by logic unit 100. After such relief, the actuator of the receiving hopper gas sealing valve 53 is signalled by logic unit 100 to open the valve. After valve 53 is open the actuator of the receiving hopper material gate 65 is signalled by logic unit 100 to open. Material in the receiving hopper 60 then flows into the distribution hopper 43, as shown. When the load cells 44 of the distribution hopper indicate that hoper 43 contains the predetermined full weight of charge material, the receiving hopper material gate 65 is signalled by unit 100 to close; this gate is capable of closing against flow of material if required. After gate 65 is closed, the receiving hopper gas sealing valve 53 is also signalled to closed. After this valve is closed, the gas equalizer valve 72 is opened by control of logic unit 100 to allow entrance of pressurized gas into distribution hopper 43 to bring the interior of the hopper to furnace to pressure.

The above sequence of operations under control of logic unit 100 continues until the stock rods 75, 76 signal that the stockline is at the desired level and the furnace is full.

Under ordinary conditions, charge material continuously discharges into receiving hopper 60, which then discharges periodically into distribution hopper 43 which in turn as required discharges into the retort 1, as described above, the whole operation operating continuously, so long as the shaft retort is heating and utilizing charge material. However, in the event of an occurrence such that the distribution hopper 43 is not ready to receive charge material from receiving hopper 60 when it is full, then the signal from load cells 61 of hopper 60 is used to halt delivery of charge material to hopper 60, as by halting operation of conveyor 67.

Figure 11:
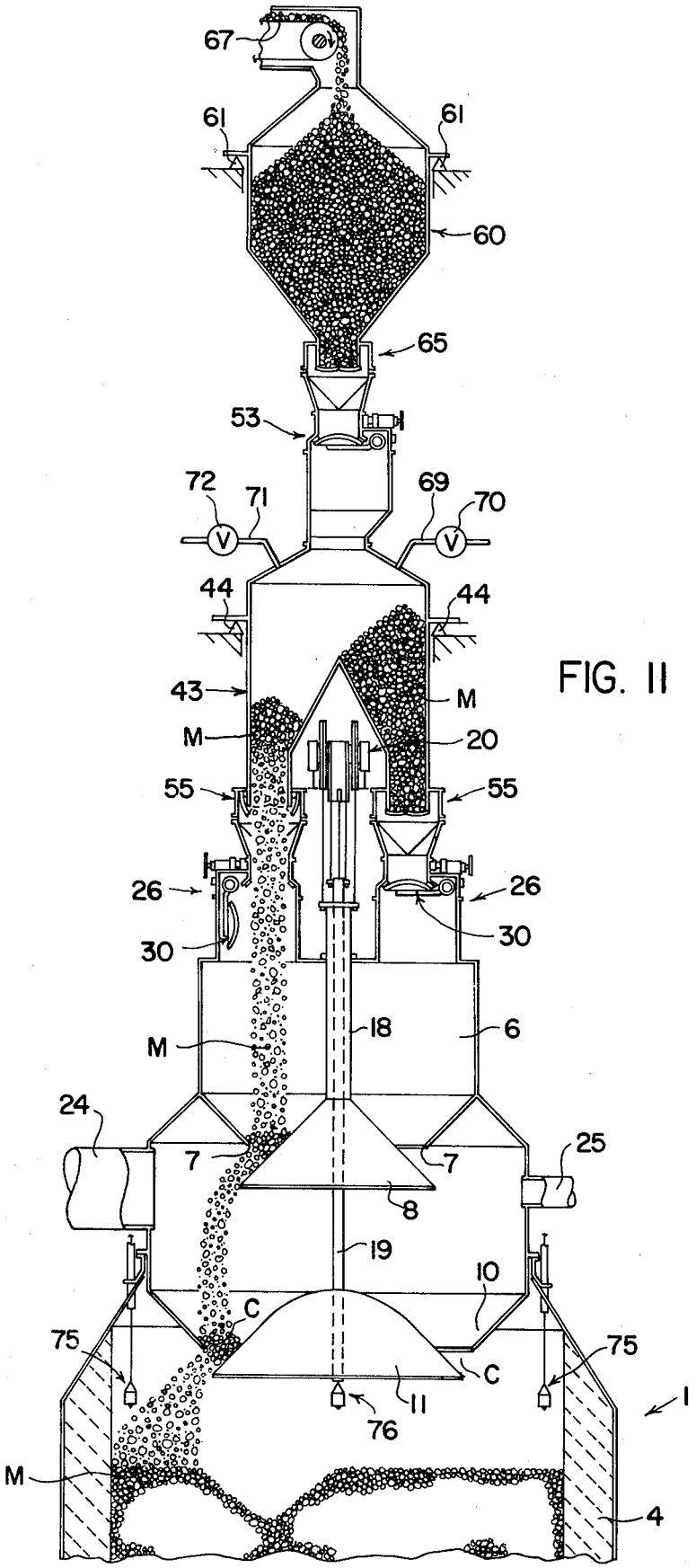
FIG. 11 is a view of the apparatus of FIG. 1 showing how an abnormal condition in which the load of charge material in the furnace has become lowered in one portion of the stockline can be corrected by the apparatus embodying the invention.

During the operation of the retort it is possible that an unevenness may occur in the stockline of the body of charge material in the retort, as due to slips or channeling. If this condition does occur, it will be sensed by the stock rods which can initiate a special sequence in the logic unit 100, in which special logic programs are set up which are capable of recognizing the location of the unevenness in the stockline, to cause the logic unit to effect coordinated use of the proper gate 55, gas valve 30 and stock rod 75 and by proper movement of the movable distributor member 11, to rectify the abnormal condition by delivering material to that particular area only in the furnace, as shown in FIG. 11. Upon correction of the abnormal condition, the unit so signals the logic unit 100, which the stock rod circuit restores the normal sequence of operations and charging will continue as required.

Various modifications may be made in the method of operation and apparatus discussed above.

Thus, the distributor member 11 may be moved from an upper position within the chamber 5 to a lower position below the outlet opening in the chamber during discharge of the material, instead of in a reverse direction as described above.

Figure 12:
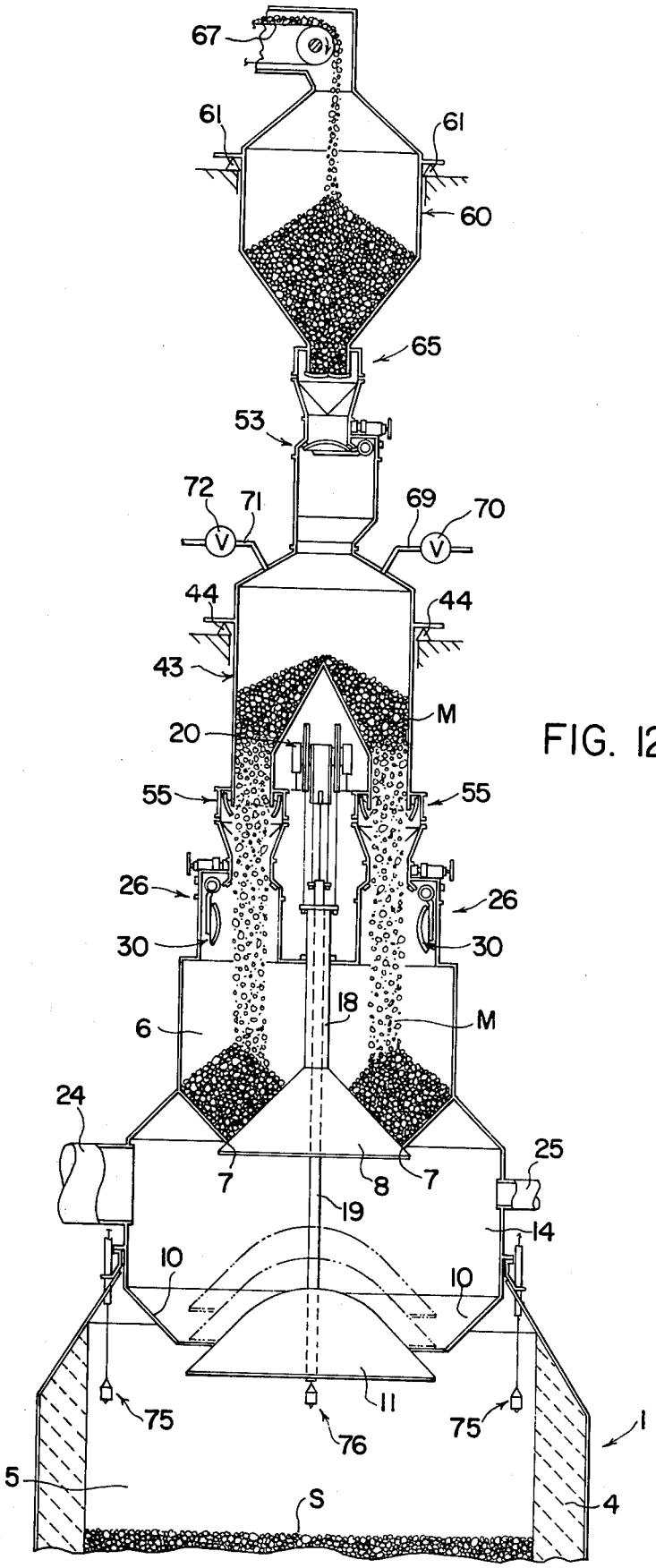
FIG. 12 is a view of the apparatus of FIG. 1 illustrating another method of operation.
Figure 13:
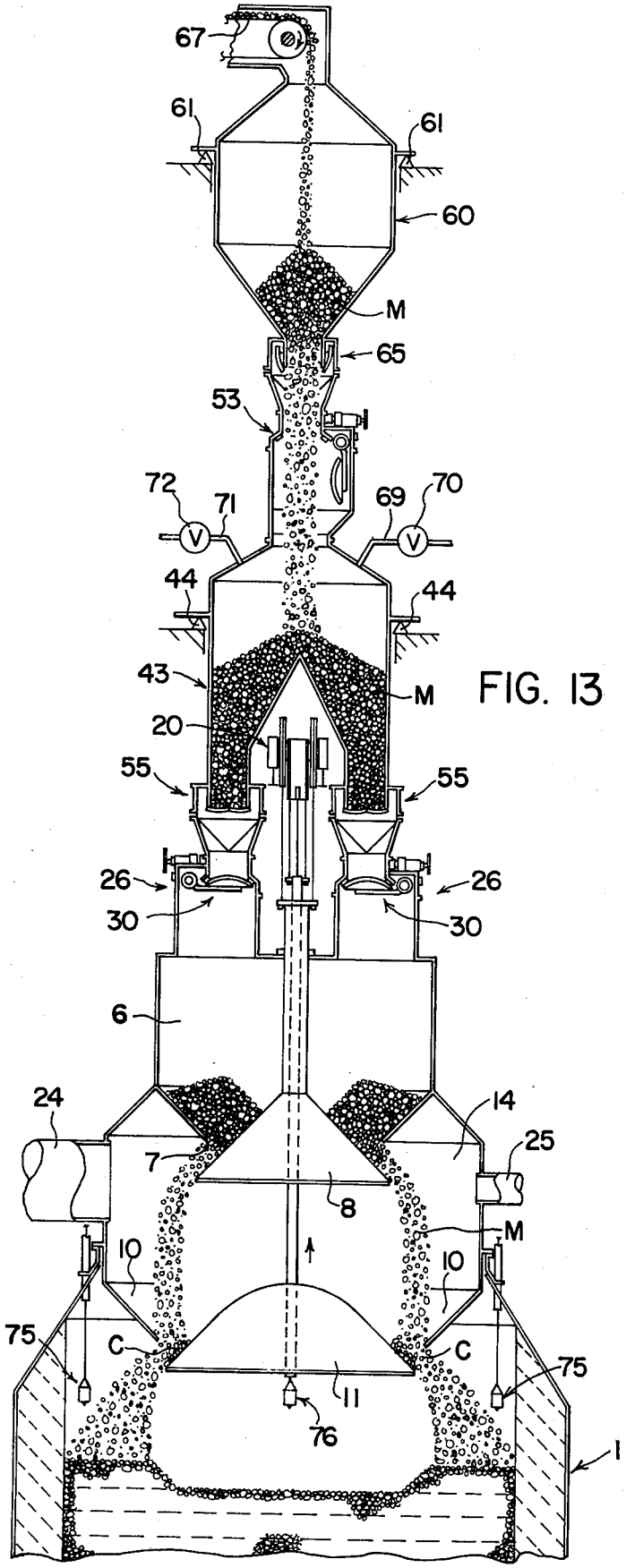
FIG. 13 is a view of the apparatus of FIG. 1 illustrating another step following the step illustrated in FIG. 12.

Moreover, a different sequence of operations may be programmed into the logic unit and used, in which sequence, upon signal from the load cells 44 and hopper 43 that the hopper has predetermined weight in it, the valves 30 and gates 55 are opened to discharge the charge material from hopper 43 into bell hopper 6 while the bottom opening 7 of hopper 6 is closed by the bell 8, as is shown in FIG. 12. Then, upon signals from the stock rod circuit that the stockline is too low, the logic unit causes bell 8 to lower, either rapidly or slowly as desired, and to discharge the charge material from the hopper into the distributor member 10 while the distributor member 11 is moving in its upwardly extending path, as from its lowermost position toward its uppermost position as illustrated in FIG. 13, or while it is traveling downwardly from its uppermost position to its lowermost position, if desired. The spreading and distributing action of the charge material is like that previously described.

The above described apparatus and modes of operation provide unique and important advantages in distributing the charge material in the furnace to provide a stockline of desired contour, until it is highly level, and also in distributing the charge material so that there is a highly uniform distribution or mixture of smaller and larger particles. This uniformity of intermixing of small and large particles arises because of the numerous changes in directions of inclinations or surfaces contacted by the charge material as it passes into and from hoppers 60 and 43, and as it strikes the inclined surfaces of hopper 6, bell 8, distributor member 10, and the moving distributor member 11. Such repeated contacts with surfaces of different inclination overcomes any segregating effects arising from the tendency of fine particles to segregate from large particles as a mass of large and small particles moves down an inclined surface, since the different inclinations of the apparatus illustrated cause the small particles to become intermixed with the large particles if they tend to segregate. Consequently, when the charge material finally is deposited in the retort, it is a mass of thoroughly intermixed large and small particles in which the differently sized particles are distributed with a high degree of uniformity.

Similar beneficial results can also be provided if the movable distributor member 11 is held stationary in various positions in its upright path as charge material is discharged downwardly into distributor means 9 comprising members 10 and 11.

Various other changes may be made in the apparatus illustrated above than those indicated. For example, while four port means and four legs of the distribution hopper 43 are disclosed the greater or lesser number of port means and legs may be used, although four port means appear to be adequate for most situations.

Different means to sense and signal the level of the stockline may be utilized, such as gas sensing means.

Figure 14:
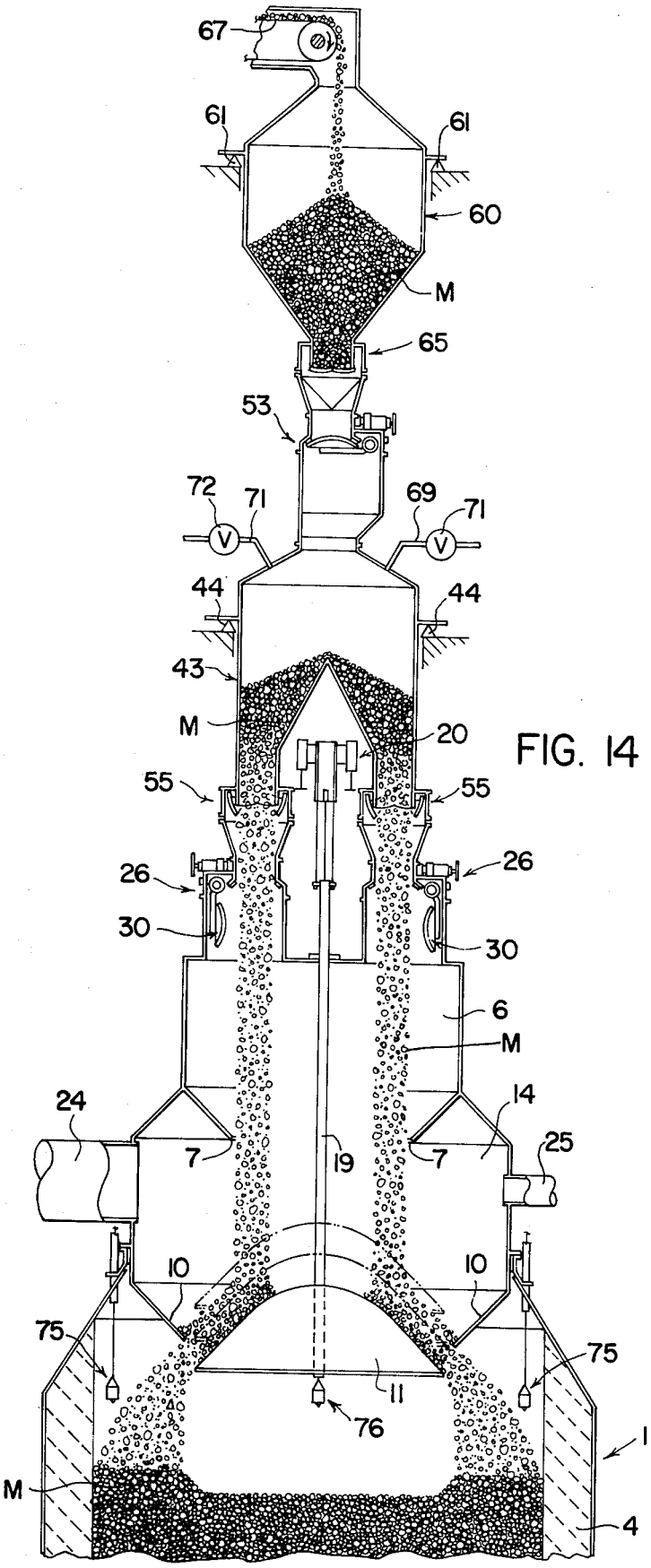
FIG. 14 is a view similar to that of the FIG. 1 and to the same scale illustrating a modification of the apparatus of FIG. 1.

Whereas the use of the spreader bell 8 is desirable to provide a desired spreading distribution of the charge material, under some circumstances such a bell may be omitted as shown in FIG. 14. The mode of operation can othewise be similar to those described above.

While in the illustrated apparatus the conveyor continuously discharges material into the receiving hopper 60 which in turn automatically discharges into the distribution hopper 43, other means of depositing material into the distribution hopper may be used. For example, charge material may be intermittently deposited into the distribution hopper as by a skip car or intermittently moving conveyor.

However, the apparatus illustrated makes possible the simultaneous operation of a plurality of shaft furnaces such as retorts, to all of which charge material is continuously supplied as by continuously moving belts or by chutes, thus making possible the use of several shaft furnaces supplied from a common source of charge material. This is desirable in some circumstances such as oil shale retorting.

In the above described embodiment, the slope of the illustrated downwardly convergent inner surface of the distributor member 10 is illustrated as approximately 45° but may be between about 45° and about 65° from the horizontal. The slope of the upwardly converging side surface of the distributor member 11 is shown as approximately 45°, but may be between about 40° to 60° from the horizontal. While the upper surface of the distributor member 11 has been shown as curved, it may be of frusto-conical or other suitable inwardly convergent shape. While the slope of the surface of the distributor member 10 has been shown as frusto-conical, it may be suitably curved.

Other modifications than those discussed above may be made.

The present invention thus provides an apparatus for charging material into a shaft furnace such as a vertical oil shale retort or blast furnace, that makes possible distribution of the material in the furnace to achieve a stockline of any desired shape within wide limits, preferably a highly level stockline, and to achieve a body of charge material in the furnace in which large and small particles are highly uniformly intermixed and distributed, by use of only a very few moving parts which are simple and rugged in construction so they do not deteriorate even over long service and so that they require little maintenance. Such desired distribution can be achieved even in furnances of large cross sectional size that require high rates of charging of material into the furnace and have a large diameter over which the charge material must be properly distributed. Moreover, the apparatus of the invention makes possible operation at furnace top pressures as high as any now used or in the foreseeable future.

The means provided by the present invention makes possible the deposition of charge material in the furnace with a high uniformity of distribution of particles sizes, and with a high uniformity of stockline level and thus makes possible desired highly uniform gas permeability in the furnace to achieve stable furnace operation, efficient utilization of gas and fuel, and efficient recovery of vapors and gases containing oil and other valuable constituents.

The above advantages are achieved in the illustrated apparatus despite the lack of any rotating mechanical components for distributing charge material, such as rotating hoppers or chutes. Omission of such rotating components provides additional advantages by eliminating problems that could otherwise arise in sealing rotating components against gas leakage, and in maintenance of such components either inside or outside of the retort, as well as by eliminating substantial costs that would arise from the more complicated construction and maintenance of apparatus with rotating components. If desired, a distribution effect similar to that of a rotating component such as a chute can be achieved in the illustrated apparatus by appropriate sequencing of gas sealing valves 30 and their associated material holding gates 55, either by manual presetting or on a programmed basis as sensed by the stock rods.

Other advantages of the invention will be apparent to those skilled in the art.

Various modifications apparent to those skilled in the art in addition to those indicated above may be made in the apparatus and processes disclosed above, and changes may be made with respect to the features disclosed, provided that the elements set forth in any of the following claims or the equivalents of such be employed.

What is claimed is:

1. Apparatus for charging particulate charge material into a receptacle comprising distributor means within the upper portion of the receptacle; gas lock means permitting entrance of charge material into said receptacle without harmful loss of gas pressure within said receptacle; temporary storage hopper means outside of and above said receptacle and adapted to receive charge material; receiving hopper means located above said temporary storage hopper means and adapted to receive charge material from a source, temporarily store said charge material and discharge said charge material directly into said temporary storage hopper means; means for causing said charge material to discharge from said receiving hopper means into said temporary storage hopper means when said temporary storage hopper means is empty of charge material to a predetermined degree; and means for discharging charge material from said temporary storage hopper means directly downward by gravity into said receptacle through said gas lock means after said charge material has been introduced into said temporary storage means and after the need for additional charge material in said receptacle has been sensed.

2. The apparatus of claim 1 in which said distributor means comprises an outer distributor member providing a chamber having a lower opening into which member charge material is deposited from said temporary storage hopper means, an inner distributor member having a maximum perimeter portion of a cross section smaller than but approaching the cross section of the said opening in the outer member, and means for causing relative movement between said distributor members in an upright path between a position in which the maximum perimeter portion of said inner distributor member is located below said opening in said outer distributor member and a position in which said maximum perimeter portion is located above the opening in the outer distributor member.

3. The apparatus of claim 2 in which said means for causing relative movement between said distributor members causes such relative movement while charge material is being discharged from said temporary storage hopper means into said outer distributor member of said distributor means.

4. The apparatus of claim 3 in which said relative movement occurs between an initial position in which said maximum perimeter portion of said inner distributor member is below said opening in said outer distributor member and a final position in which said maximum perimeter portion is above an opening in said outer distributor member.

5. The apparatus of claim 1 comprising means adapted to sense the height of the stockline of charge material in said receptacle, and means operatively associated with said stockline sensing means for causing said means for discharging charge material from said temporary storage hopper means to discharge material from said hopper means into said receptacle when said stockline sensing means senses that the stockline has moved in said receptacle below a predetermined height.

6. The apparatus of claim 5 comprising material holding means and gas sealing valve means between said temporary storage hopper means and said receptacle, and means for causing both said material holding means and said gas sealing valve means to open to permit said charge material to pass from said temporary storage hopper means means into said receptacle when said stockline sensing means indicates that the stockline has moved below said predetermined height.

7. The apparatus of claim 5 in which said stockline sensing means is adapted to sense the height of the stockline at a plurality of locations outwardly from the center of the stockline and at a location generally centrally of the stockline.

8. The apparatus of claim 7 in which said plurality of stockline sensing means are stock rods.

9. The apparatus of claim 1 comprising spreader means between said gas lock means and said distributor means acting to spread laterally charge material discharged in and falling into said outer distributor member.

10. The apparatus of claim 9 in which said spreader means is a bell having an upwardly inwardly covergent top surface, and which apparatus comprises a hopper having a bottom opening adapted to be closed by said bell.

11. Apparatus for charging particulate charge material into a receptacle adapted to contain charge material in a body having a stockline, comprising distributor means at the upper portion of said receptacle; temporary storage hopper means outside of and above said receptacle and adapted to receive charge material; material holding means between said temporary storage hopper means and said receptacle adapted to be opened to discharge material from said temporary storage hopper means into said receptacle and to be closed to retain charge material in said temporary storage hopper means; stocklline sensing means for sensing the height of the stockline in said receptacle; means for opening said material holding means to discharge charge material directly into said receptacle from said temporary storage hopper means when said stockline sensing means senses that said stockline has moved below a predetermined height; receiving hopper means in proximity to said temporary storage hopper means and adapted to receive charge material from a source and temporarily store charge material and discharge charge material into said temporary storage hopper means; and means for causing said charge material to discharge from said receiving hopper means into said temporary storage hopper means when said temporary storage hopper means is empty of charge material to a predetermined degree.

12. The apparatus of claim 11 comprising gas sealing means located between said temporary storage hopper means and said receptacle and below said material holding means; and means for opening said gas sealing means before said material holding means when said stockline sensing means senses that said stockline has moved below a predetermined height.

13. Apparatus for charging particulate charge material into a receptacle adapted to contain a body of charge material having a stockline comprising distributor means within the upper portion of said receptacle; hopper means outside of an above said receptacle and having upper port means through which charge material is deposited in said hopper means; first gas sealing means in said upper port means adapted to be open and closed; material holding means between said hopper means and said receptacle adapted to be opened to discharge charge material from said hopper means directly downwardly by gravity into said receptacle and to be closed to retain charge material in said hopper means; second gas sealing means between said hopper means and said receptacle and below said material holding means adapted to be opened to permit charge material to pass from said hopper means into said receptacle and to be closed to retain gas pressure within said receptacle; stockline sensing means for sensing the height of the stockline in said receptacle; means for opening said second gas sealing means and thereafter opening said material holding means to discharge charge material into said receptacle when said stockline sensing means senses that said stockline has moved below a predetermined height, said means operating to open said second gas sealing means and said material holding means only when said first gas sealing means is closed; and means for opening said first gas sealing valve means to permit charge material to be introduced into said hopper means to provide a predetermined amount of charge material therein when said hopper means is empty to a predetermined degree and when said material holding means and said second gas sealing means are closed.

14. Apparatus for charging particulate charge material into a receptacle adapted to contain a body of charge material having a stockline, comprising distributor means within the upper portion of said receptacle; first hopper means outside of and above said receptacle and having upper port means through which charge material is deposited in said first hopper means; first gas sealing means in said upper port means adapted to be opened and closed; material holding means between said first hopper means and said receptacle adapted to be opened to discharge charge material from said hopper means directly downwardly by gravity into said receptacle and to be closed to retain charge material in said hopper means; second gas sealing means between said first hopper means and said receptacle and below said material holding means adapted to be opened to permit charge material to pass from said first hopper means into said receptacle and to be closed to retain gas pressure within said receptacle; stockline sensing means for sensing the height of the stockline in said receptacle; means for opening said second gas sealing means and thereafter opening said material holding means to discharge charge material into said receptacle when said stockline sensing means senses that said stockline has moved below a predetermined height, said means operating to open said second gas sealing means and said material holding means only when said first gas sealing means is closed; second hopper means above said first hopper means adapted to receive charge material from a source, temporarily store charge material, and to discharge charge material into said first hopper means; and means for opening said first gas sealing means and to cause charge material to discharge from said second hopper means into said first hopper means when said first hopper means is empty of charge material to a predetermined degree and when said material holding means and said second gas sealing means are closed.

15. The apparatus of claim 14 comprising means for substantially continuously depositing charge material into said second hopper means.

16. Apparatus for charging particulate charge material into a receptacle comprising distributor means within the upper portion of the receptacle; gas lock means permitting entrance of charge material into the receptacle without harmful loss of gas pressure within said receptacle; temporary storage hopper means outside of and above said receptacle and adapted to receive charge material; means for introducing into said temporary storage hopper means a predetermined amount of charge material; means for discharging said charge material from said temporary storage hopper means directly downwardly by gravity into said receptacle through said gas lock means after said predetermined amount of charge material has been introduced into said temporary storage hopper means and after the need for additional charge material in said receptacle has been sensed; and means for weighing the charge material while it is in said temporary storage hopper means and for actuating said means for introducing charge material into said temporary storage hopper means to halt introduction of charge material into said temporary storage hopper means after a predetermined weight of charge material has been introduced into said temporary storage hopper means.

17. Apparatus for charging particulate charge material into a receptacle adapted to contain charge material in a body having a stockline, comprising distributor means at the upper portion of said receptacle; temporary storage hopper means outside of and above said receptacle and adapted to receive charge material; material holding means between said temporary storage hopper means and said receptacle adapted to be opened to discharge charge material directly downwardly by gravity from said temporary storage hopper means into said receptacle and to be closed to retain charge material in said temporary storage hopper means; stockline sensing means for sensing the height of the stockline in said receptacle; means for opening said material holding means to discharge charge material into said receptacle when said stockline sensing means senses that the stockline has moved below a predetermined height; and means for weighing the charge material while it is in said temporary storage hopper means and for actuating said means for introducing charge material into said temporary storage hopper means after a predetermined weight of charge material has been introduced into said temporary storage hopper means.

18. Apparatus for charging particulate charge material into a receptacle adapted to contain a body of charge material having a stockline, comprising distributor means at the upper portion of said receptacle; hopper means outside of and above said receptacle and having upper port means through which charge material is deposited in said hopper means; first gas sealing means in said upper port means adapted to be opened and closed; material holding means between said hopper means and said receptacle adapted to be opened to discharge charge material from said hopper means directly downwardly by gravity into said receptacle and to be closed to retain charge material in said hopper means; second gas sealing means between said hopper means and said receptacle and below said material holding means adapted to be opened to permit charge material to pass from said hopper means into said receptacle and to be closed to retain gas pressure within said receptacle; stockline sensing means for sensing the height of the stockline in said receptacle; means for opening said second gas sealing means and thereafter opening said material holding means to discharge charge material into said receptacle when said stockline sensing means senses that said stockline has moved below a predetermined height, said means operating to open said second gas sealing means and said material holding means only when said first gas sealing means is closed; means for opening said first gas sealing means to permit charge material to be introduced into said hopper means when said hopper means is empty to a predetermined degree and when said material holding means and said second gas sealing means are closed; and means for weighing the amount of charge material in said hopper means and for actuating said means for opening said first gas sealing means to introduce into said hopper means a predetermined weight of charge material.

* * * * *